US008507070B2

(12) United States Patent
Person

(10) Patent No.: US 8,507,070 B2
(45) Date of Patent: Aug. 13, 2013

(54) CEDAR SPILL

(76) Inventor: Thomas A. Person, Louisville, KY (US)

( * ) Notice: Subject to any disclaimer, the term of this patent is extended or adjusted under 35 U.S.C. 154(b) by 229 days.

(21) Appl. No.: 13/216,925

(22) Filed: Aug. 24, 2011

(65) Prior Publication Data

US 2013/0052397 A1 Feb. 28, 2013

(51) Int. Cl.
*B32B 5/00* (2006.01)

(52) U.S. Cl.
USPC ..... 428/80

(58) Field of Classification Search
USPC ..... 428/80
See application file for complete search history.

(56) References Cited

U.S. PATENT DOCUMENTS 6,053,175 A 4/2000 D'Angelo
6,298,856 B1 10/2001 Park
6,476,359 B2 11/2002 Rostan

*Primary Examiner* — Alexander Thomas
(74) *Attorney, Agent, or Firm* — Joan L. Simunic

(57) ABSTRACT

The present invention is a cedar spill having defined dimensions which are optimized for lighting a cigar. In a preferred embodiment, the cedar spill is produced from a Spanish cedar sheet and has a relatively long, tapered body.

17 Claims, 4 Drawing Sheets

L
$W_F$
$W_L$
T
10

CEDAR SPILL

CROSS-REFERENCE TO PRIOR APPLICATIONS

The present application does not claim cross-reference to any prior applications.

BACKGROUND

The present invention is a cedar spill having dimensions that produce optimum conditions for lighting a cigar.

Cedar spills, or cedar splits, are an historic and traditional method for lighting a cigar. Use of the cedar spill helps preserve and protect the taste and/or flavor of the cigar. The user lights the cedar spill and then carefully lights the open tip of the cigar by rotating the cigar over the flame. Alternatively, matches or butane lighters may be used to light the cigar, but these lighting devices frequently scorch or contaminate the tobacco, oils and water within the cigar upon lighting giving the cigar an off-taste.

Traditionally, cedar spills are produced from a cedar sheet which is commonly provided with the cigars in a cigar box. The cedar spills are made by folding the cedar sheet to a desired width and breaking the spill or strip off at the fold seam. While this is a relatively easy task for the cigar smoker, there is little consistency in the width of the strip and no variation in the intensity of the flame along the length of the cedar spill.

SUMMARY OF THE PREFERRED EMBODIMENT

The present invention is a cedar spill having defined dimensions which are optimized for lighting a cigar. In a preferred embodiment, the cedar spill is produced from a piece of wood has a continuous and even burn rate that leaves only the burnt ash and minimal embers, such as a Spanish cedar sheet, having a thickness of from about 0.55 millimeters to about 0.65 millimeters. The cedar spill of the present development has a preferred length of from about 150 millimeters to about 300 millimeters. In a preferred embodiment, the cedar spill is tapered so that the spill has a width of about 12-20 millimeters at a first end and a width of about 6-10 millimeters at a second end.

DETAILED DESCRIPTION OF THE PREFERRED EMBODIMENT

Figure 1:
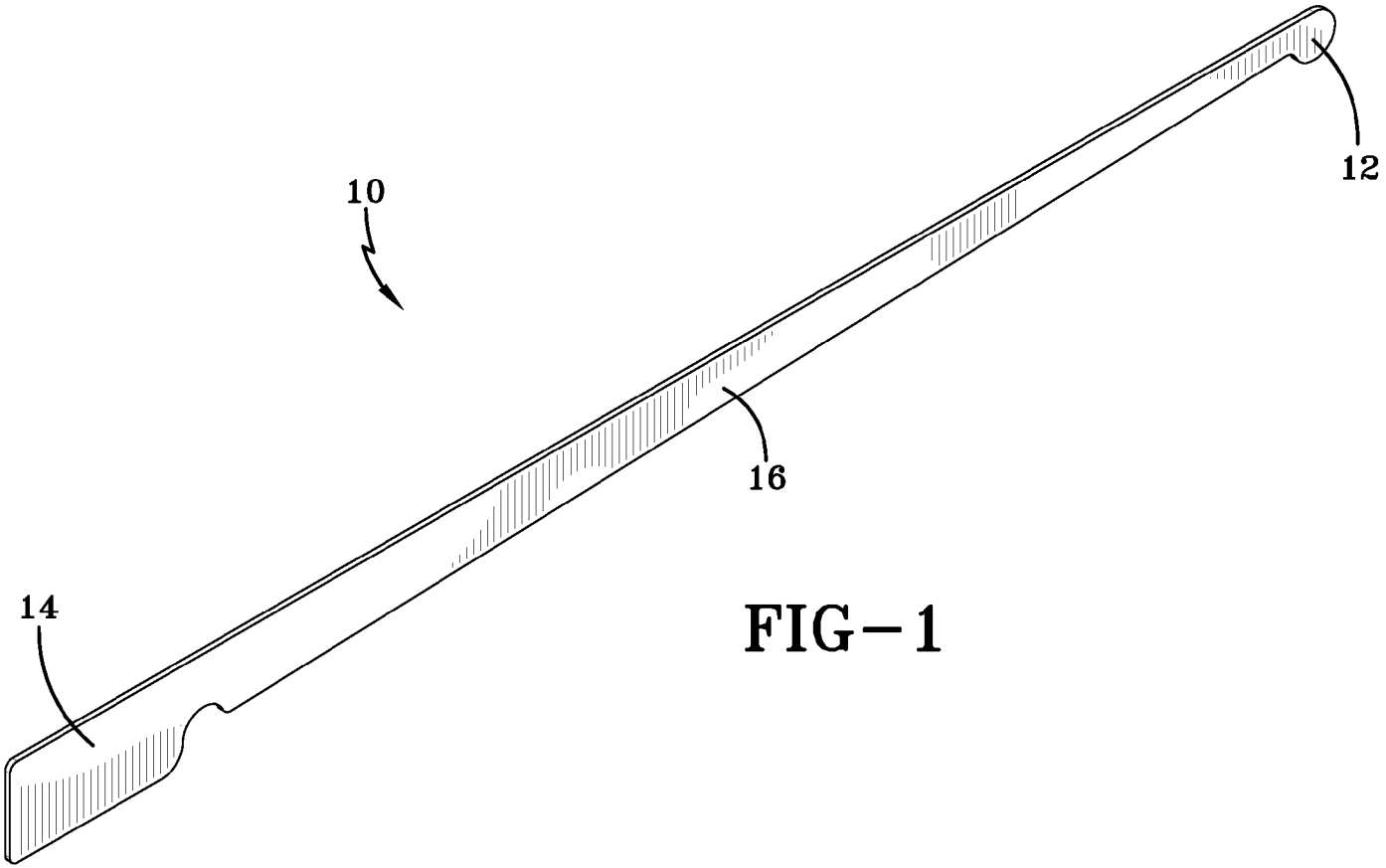
FIG. 1 is a top perspective view of a cedar spill of the present invention.
Figures 2, 3, 4, 5, 6, 7:
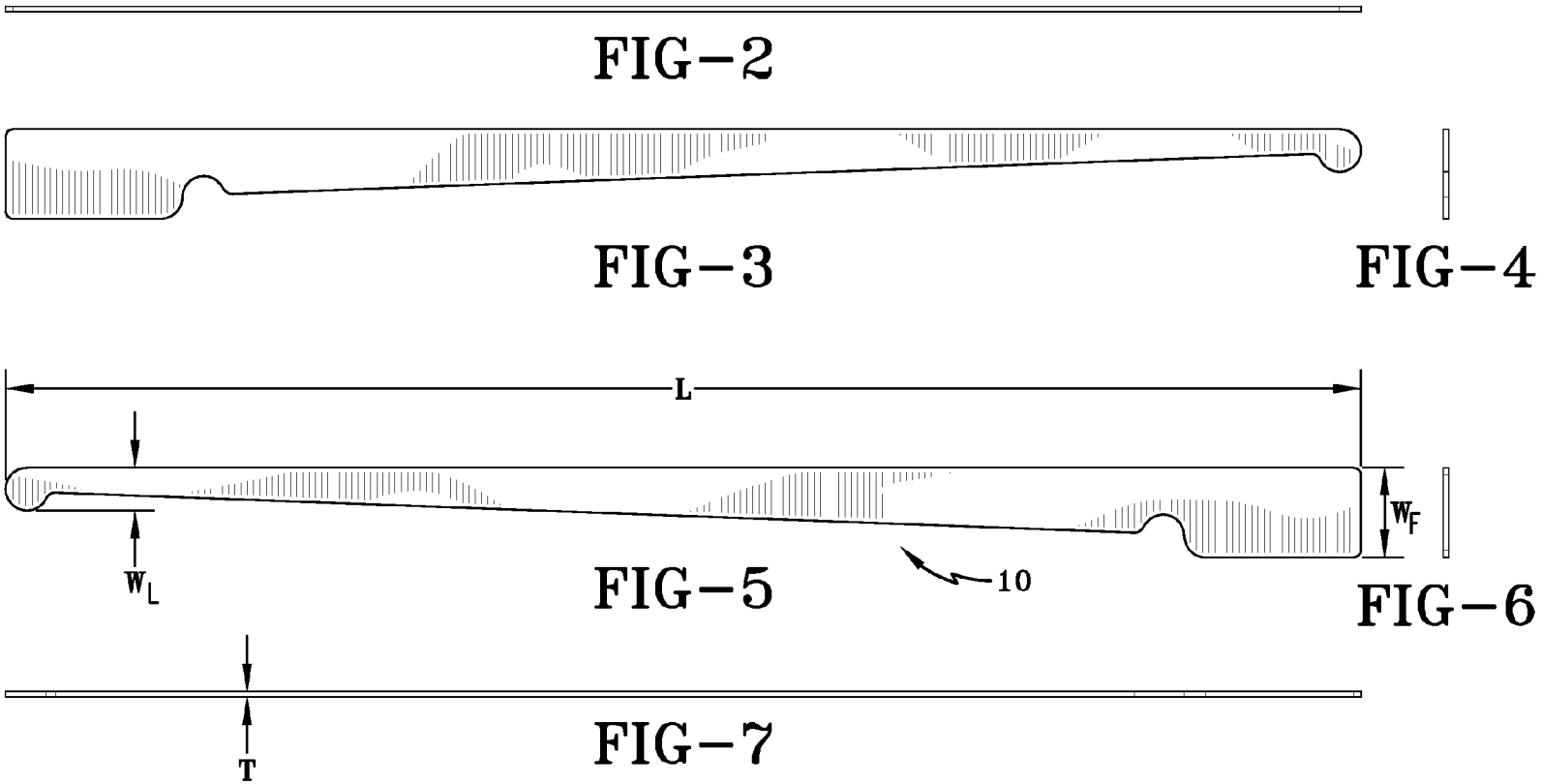
FIG. 2 is a top view of the cedar spill of FIG. 1.
FIG. 3 is a first side view of the cedar spill of FIG. 1.
FIG. 4 is a front view of the cedar spill of FIG. 1.
FIG. 5 is a second side view of the cedar spill of FIG. 1.
FIG. 6 is a back view of the cedar spill of FIG. 1.
FIG. 7 is a bottom view of the cedar spill of FIG. 1.

The cedar spill depicted in the various Figures is selected solely for the purposes of illustrating the invention. Other and different cedar spills may utilize the inventive features described herein as well. The illustrations are not intended to be representative with respect to dimensions.

Reference is first made to FIGS. 1 through 7 in which a cedar spill constructed in accordance with the present invention is generally noted by the character numeral 10. The cedar spill 10 has a first end or lighting end 12, a second end or finger end 14, and a body 16. Further, the cedar spill 10 defines a length L, a first width $W_L$, a second width $W_F$, and a thickness T.

Spanish cedar wood is highly recommended for production of the cedar spill 10 of the present invention because it has a continuous and even burn rate that leaves only the burnt ash and minimal embers. However, any wood that with an even burn rate may be used to manufacture the spill 10 of the present invention. In a preferred embodiment, the cedar spill 10 is made from Spanish cedar wood.

More preferably, the cedar wood has a grade of A or AA as defined by the Architectural Woodwork Institute Quality Standards Illustrated $8^{th}$ Edition. Most preferably, the cedar wood has an AA grading.

In a preferred embodiment, the cedar spill of the present invention has a thickness T of from about 0.50 millimeters to about 0.70 millimeters. More preferably, the cedar spill has a thickness T of from about 0.55 millimeters to about 0.65 millimeters. Most preferably, the cedar spill has a thickness T of about 0.60 millimeters.

The cedar spill of the present invention has a preferred length L of from about 150 millimeters to about 300 millimeters. More preferably, the cedar spill has a length L of from about 165 millimeters to about 250 millimeters. Most preferably, the cedar spill has a length L of from about 165 millimeters to about 200 millimeters.

The cedar spill of the present invention is tapered along the body 16 so that the width at the lighting end 12, or first width $W_L$, is narrower than the width at the finger end 14, or the second width $W_F$. Tapering allows for easy ignition of the lighting end 12 and modifies the intensity of the burn providing more consistent lighting for the cigar. In a preferred embodiment, the cedar spill is tapered so that the spill has a finger-end width $W_F$ of about 12-20 millimeters and a lighting-end width $W_L$ of about 6-10 millimeters. More preferably, the cedar spill is tapered so that the spill has a finger-end width $W_F$ of about 14-18 millimeters and a lighting-end width $W_L$ of about 8-9 millimeters. Most preferably, the cedar spill is tapered so that the spill has a finger-end width $W_F$ of about 16 millimeters and a lighting-end width $W_L$ of about 8.5 millimeters.

Figure 8:
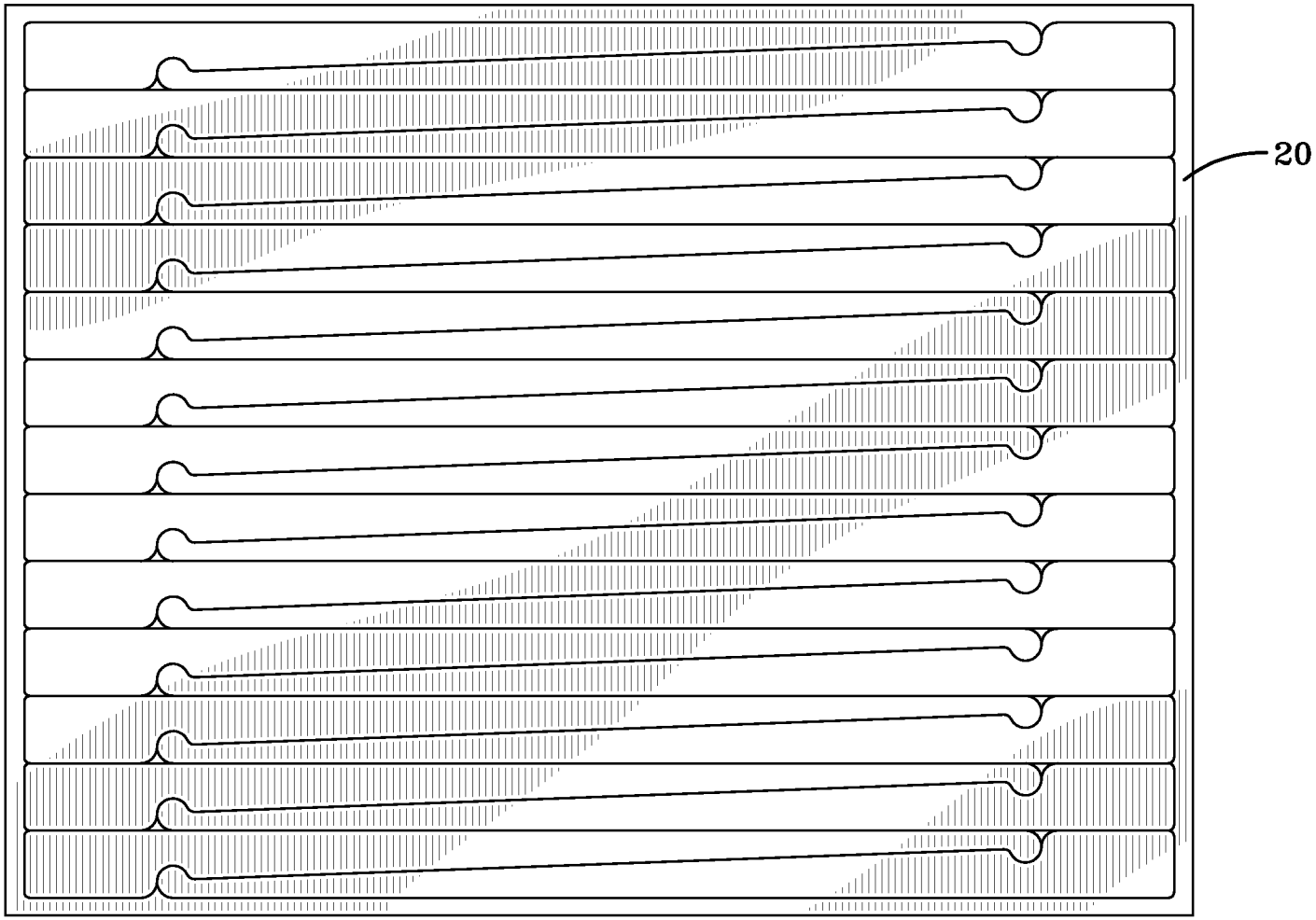
FIG. 8 is a top view of a scored cedar sheet for producing the cedar spill of FIG. 1.

The design of the cedar spill 10 of the present invention allows for easy production and distribution. As shown in FIG. 8, a plurality of cedar spills 10 may be die cut into a sheet 20 of cedar wood. Individual spills can be separated from the sheet 20 prior to distribution to the end user or the end user may be provided with the scored sheet 10, for example as an insert in a cigar box, and the user may separate each spill from the sheet as needed.

Figure 9:
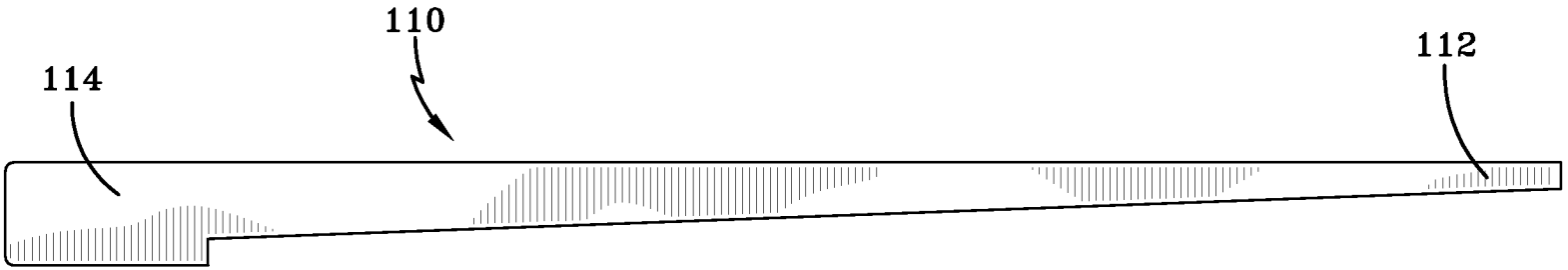
FIG. 9 is a first alternative embodiment of the cedar spill made in accordance with the present invention.
Figure 10:
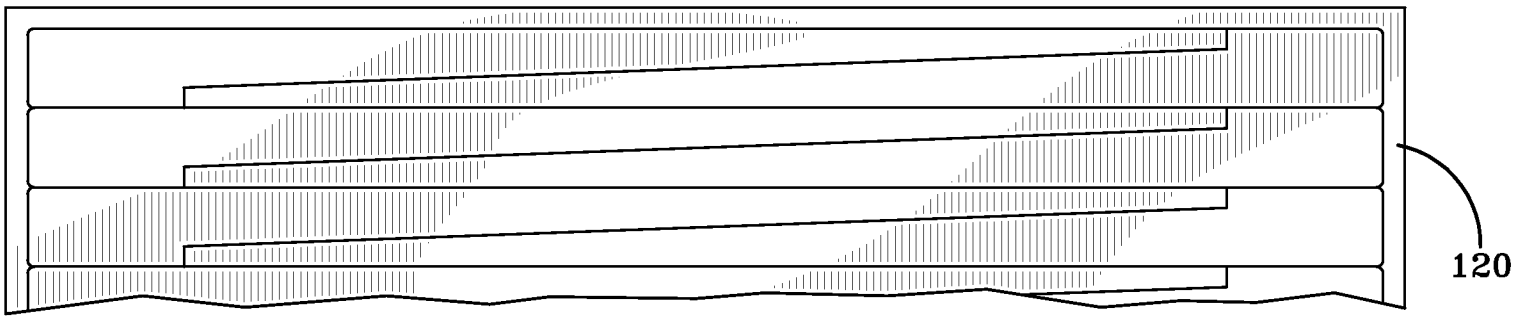
FIG. 10 is a top view of a scored cedar sheet for producing the cedar spill of FIG. 9.

The rounded design at the lighting end 12 is not a required feature of the inventive cedar spill 10. For example, an alternative spill 110 may have a squared lighting end 112 and/or a squared fingered end 114 as shown in FIG. 9. Similar to the embodiment of FIGS. 1-8, a plurality of alternative spills 110 can be die cut from a sheet of wood.

It is understood that, in light of a reading of the foregoing description and drawings, those with ordinary skill in the art will be able to make changes and modifications to the present invention without departing from the spirit or scope of the invention, as defined herein. For example, those skilled in the art may use different end designs than the two shown herein. Such variations are anticipated within the scope of the present invention.

What is claimed is:

1. A cedar spill comprising a piece of wood that has a continuous and even burn rate that leaves only burnt ash and minimal embers, said piece of wood having a body defining a length L and thickness T and having first end defining a width $W_L$ and a second end defining a width $W_F$, and wherein said body is tapered such that the width at the first end $W_L$ is narrower than the width at the second end $W_F$.

2. The cedar spill of claim 1 wherein said piece of wood is selected from Spanish cedar wood having a grade of A or AA.

3. The cedar spill of claim 1 wherein said body has a thickness T of from about 0.50 millimeters to about 0.70 millimeters.

4. The cedar spill of claim 3 wherein said body has a thickness T of from about 0.55 millimeters to about 0.65 millimeters.

5. The cedar spill of claim 1 wherein said body has a length L of from about 150 millimeters to about 300 millimeters.

6. The cedar spill of claim 5 wherein said body has a length L of from about 165 millimeters to about 250 millimeters.

7. The cedar spill of claim 6 wherein said body has a length L of from about 165 millimeters to about 200 millimeters.

8. The cedar spill of claim 1 wherein said first end width $W_L$ is from about 6 millimeters to about 10 millimeters.

9. The cedar spill of claim 8 wherein said first end width $W_L$ is from about 8 millimeters to about 9 millimeters.

10. The cedar spill of claim 1 wherein said second end width $W_F$ is from about 12 millimeters to about 20 millimeters.

11. The cedar spill of claim 10 wherein said second end width $W_F$ is from about 14 millimeters to about 18 millimeters.

12. The cedar spill of claim 1 wherein said first end has a rounded configuration.

13. The cedar spill of claim 1 formed by stamping the configuration of a plurality of said cedar spills onto said piece of wood and scoring said piece of wood such that an individual cedar spill can be separated from said piece of wood with human finger pressure.

14. A cedar spill comprising a piece of wood having a body defining a length L and thickness T and having first end defining a width $W_L$ and a second end defining a width $W_F$, and wherein said body length L is from about 165 millimeters to about 200 millimeters and said body thickness T is from about 0.55 millimeters to about 0.65 millimeters, and wherein said body is tapered such that the width at the first end $W_L$ is narrower than the width at the second end $W_F$.

15. The cedar spill of claim 14 wherein said first end width $W_L$ is from about 8 millimeters to about 9 millimeters.

16. The cedar spill of claim 14 wherein said second end width $W_F$ is from about 14 millimeters to about 18 millimeters.

17. The cedar spill of claim 14 wherein said piece of wood is selected from Spanish cedar wood having a grade of A or AA.

* * * * *